US005389029A

United States Patent [19]

McAvoy, Jr.

[11] Patent Number: 5,389,029

[45] Date of Patent: * Feb. 14, 1995

[54] ADJUSTABLE PERFORMANCE YO-YO

[76] Inventor: John J. McAvoy, Jr., 1428 S.W. 137, Seattle, Wash. 98166

[ * ] Notice: The portion of the term of this patent subsequent to Oct. 19, 2010 has been disclaimed.

[21] Appl. No.: 52,717

[22] Filed: Apr. 27, 1993

Related U.S. Application Data

[63] Continuation-in-part of Ser. No. 806,480, Dec. 13, 1991, Pat. No. 5,254,027.

[51] Int. Cl.[6] ..... A63H 1/30

[52] U.S. Cl. ..... 446/250; 446/253

[58] Field of Search ..... 446/250, 248, 251, 253, 446/263, 264

[56] References Cited

U.S. PATENT DOCUMENTS

| | | | |
|---|---|---|---|
| 2,247,315 | 6/1941 | Singer | 446/251 |
| 2,387,565 | 10/1945 | Criner | 446/251 |
| 2,558,464 | 6/1951 | Schultz | 446/251 X |
| 2,891,351 | 6/1959 | Madaras et al. | 446/250 |
| 3,175,326 | 3/1965 | Isaacson | 446/250 |
| 3,201,895 | 8/1965 | Stivers | 446/250 |
| 4,130,962 | 12/1978 | Ennis | 446/250 |
| 4,207,701 | 6/1980 | Kuhn | 446/250 |
| 4,273,275 | 6/1981 | Vadnais | 446/250 X |
| 5,100,361 | 3/1992 | Kuhn et al. | 446/250 |

FOREIGN PATENT DOCUMENTS

| | | | |
|---|---|---|---|
| 758032 | 1/1934 | France | 446/250 |

*Primary Examiner*—Danton D. DeMille

[57] ABSTRACT

An adjustable performance yo-yo, allowing the operator to optimize the degree of frictional drag maximizing sleep time and being able to return the yo-yo to the hand at will. The invention uses a single woven polyester cord tether uniquely attached to a yoke on a small diameter threaded floating axle. The standard twisted pair strand tether is also use. Two rotating inertial disks have extended smooth surfaces referred to as lapper disks located near the center of rotation making skimming contact with the tether. The frictional drag is adjusted by rotating a threaded knob on the end of the axle which effects the proximity of the lapper disk to the tether. The two inertial disks spin independently of each other. The two body halves are made of a resilient material which cushions the hand from impact of a rapid return of the yo-yo. A hitch is used to form a running noose on the hand end of the tether. A Velcro strap is also used.

11 Claims, 3 Drawing Sheets

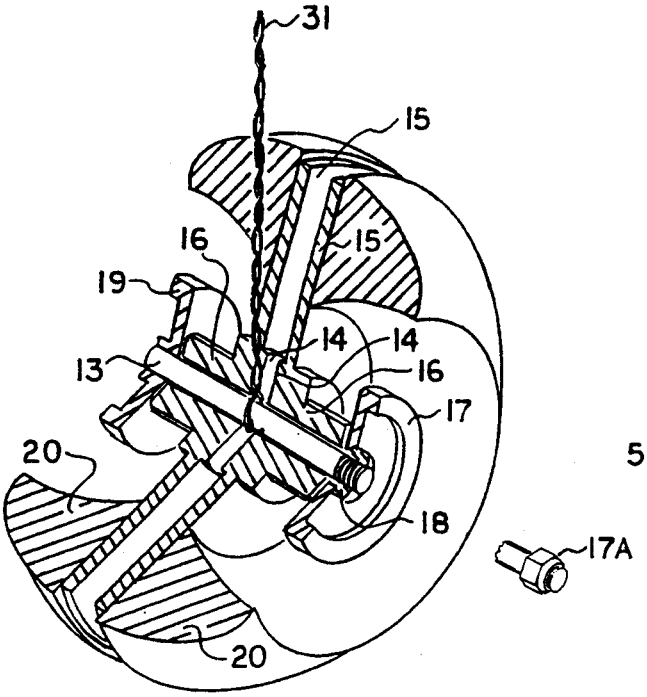
FIG 13
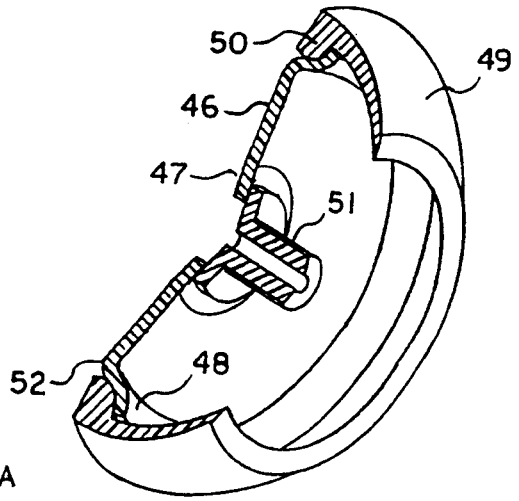
FIG 14
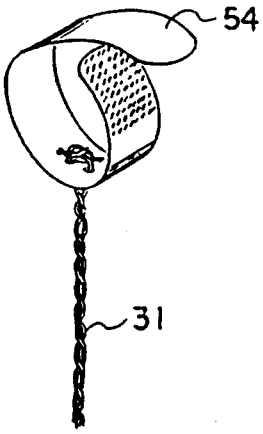
FIG 15
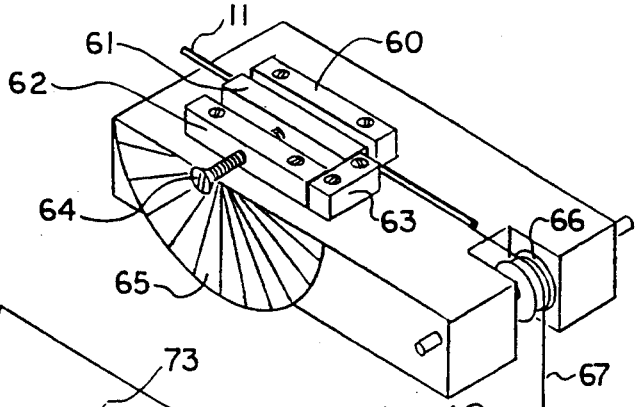
FIG 16
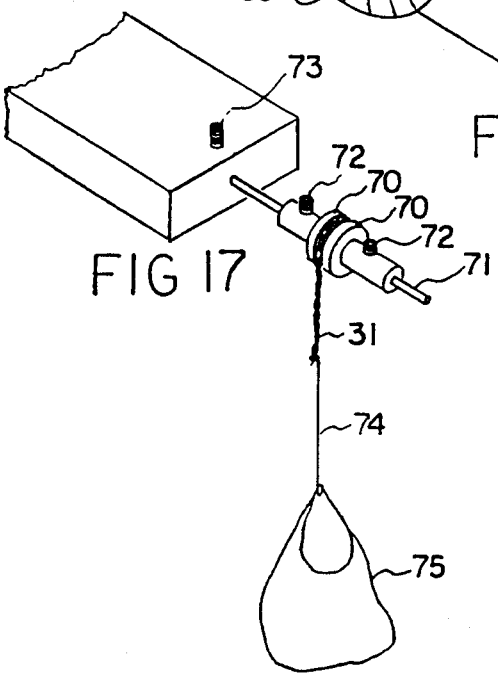
FIG 17
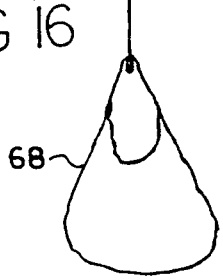

ADJUSTABLE PERFORMANCE YO-YO

This application is a continuation-in-part of Ser. No. 07/806,480, filed Dec. 13, 1991, now U.S. Pat. No. 5,254,027.

BACKGROUND OF THE INVENTION

1. Field of the Invention

This invention relates in general to the field of rotating toys. More specifically it relates to the yo-yo.

2. Description of Prior Art

The term yo-yo was derived from the equivalent meaning of come-come in the native language of the Philippines where the toy is thought to have evolved from an ancient weapon. Stones with a groove around the periphery have been found in archaeological sites. It is believed that the groove was carved in order to secure a twine or strip of leather to the stone. A warrior or hunter could thus throw the stone, quickly recover it and throw it again. Archaeologists have shown that over many years the groove had been made deeper, presumedly at first to allow the twine to be all wound within the groove for the convenience of carrying it. The user would not have thrown the stone from the wound-up condition to wound an animal or an enemy because this would have resulted in primarily rotational speed of the stone instead of linear speed. The first to have carved a deep groove would have allowed the stone to drop while holding the end of the twine only for the purpose of letting the string out. When the stone reached the end of twine and rotated back up the string the come-come was discovered.

In the 1920s a Phillipino named Pedro Flores invented the sleeping yo-yo. Instead of tying the string to the axle, he looped the string around the axle to allow the yo-yo to spin freely in the loop at the end of the string without returning up to the user's hand. This free spinning is referred to as sleeping. The sleep condition is used to perform many trick maneuvers. The yo-yo may be returned to the users hand from the sleep condition by a slight jerk of the string. The phenomenon that takes place here is that: Following the jerk, the string becomes slack for a moment and allows the semi-tight loop to wind up on the axle, increasing the frictional drag as more string is wound around the axle and becomes wedged in the gap between the inertial masses.

There have been numerous efforts to improve yo-yo performance. A novelty search of prior art relating to the yo-yo discovered the following patents:

| U.S. Pat. No. | | Classification | Inventor |
|---|---|---|---|
| 1,419,402 | 6/1922 | 446/250 | Mosher |
| 2,591,954 | 4/1952 | 446/250 | Madsen |
| 2,629,202 | 3/1953 | 446/250 | Stivers et. al. |
| 2,645,881 | 7/1953 | 446/250 | Frangos |
| 2,676,432 | 4/1954 | 446/250 | Field |
| 2,773,328 | 12/1956 | 446/250 | Fraenkel et. al. |
| 2,891,351 | 6/1959 | 446/250 | Madaras et. al. |
| 2,975,547 | 3/1961 | 446/250 | Greve |
| 3,081,578 | 3/1963 | 446/250 | Mosher |
| 3,175,326 | 3/1965 | 446/250 | Isaacson |
| 3,184,885 | 5/1965 | 446/250 | Gibson |
| 3,256,635 | 6/1966 | 446/250 | Radovan |
| 3,444,644 | 5/1969 | 446/251 | Sayegh |
| 3,805,443 | 4/1974 | 446/250 | Duncan |
| 4,130,962 | 12/1978 | 446/250 | Ennis |
| 4,207,701 | 6/1980 | 446/250 | Kuhn |
| 4,290,225 | 9/1981 | 446/250 | MacCarthy |
| 4,318,243 | 3/1982 | 446/250 | MacCarthy |

-continued

| U.S. Pat. No. | | | Classification | Inventor |
|---|---|---|---|---|
| 4,332,102 | 6/1982 | | 446/250 | Caffrey |
| 4,437,261 | 3/1984 | | 446/250 | MacCarthy |
| 4,442,625 | 4/1984 | | 446/250 | MacCarthy |
| 4,895,547 | 1/1990 | | 446/250 | Amaral |
| 5,017,172 | 5/1991 | | 446/250 | Seifert |
| 5,100,361 | 3/1992 | | 446/250 | Kuhn |
| Foreign Patents | | | | |
| 22,401 | 10/1903 | England | 446/251 | Weisshappel |
| 15,824 | 4/1904 | Austria | 446/251 | Weisshappel |
| 209,288 | 1/1924 | Philippine Islands | 446/250 | Murray |
| 504,033 | 4/1936 | England | 446/266 | Beresford |

A close approach to the disclosed construction and function of the present invention was not observed in the above cited patents. Perhaps of most merit are patents: U.S. Pat. No. 2,891,351 to Madaras et. al. claims "—bodies in adjustably connected spaced relation for receiving a spirally wound string—". The hub bosses in this invention, appearing similar in construction, have no functional relationship to the lapper disks of the present invention. The hub boss are in contact with each other as stated: "—to maintain the confronting bodies in minimum spaced relation—". The string in this invention stays outside the perimeter of the hub bosses in this invention. The trunions extending outward on this invention "—define knurled cylindrical end portions providing convenient finger gripping surfaces to impart a manual or hand spinning twist—" such that each of the two body halves may be used separately as spinning tops. These knurled trunions are not functionally equivalent to the knobs of the present invention. The knobs in the present invention are separate from the inertial disk and hubs. U.S. Pat. No. 3,256,635 to Radovan claiming radial flutes that grip the string. U.S. Pat. No. 4,130,962 to Ennis claiming cone shaped protuberances to aid the gripping of the string. U.S. Pat. No. 2,629,202 to Stivers et. al. claiming vanes on the axle surface adjacent to the central polished zone and friction disks with an adhesive characteristic ridgedly mounted on the axle to aid the binding of the string in the gap. These devices do not relate to the initiation of string wind-up. These devices make contact with the string only after the string has made several wraps around the axle and has spread out laterally. This is stated so by Stivers where he refers to the string "—shifted into contact therewith—" and "—expansion of the loop incident to relaxed tension upon the string." These devices cause the string to fray and shorten string life. The present invention utilizes smooth lapper disks where the gap between them is adjustable to make a skimming contact with the cord. U.S. Pat. No. 3,175,326 to Isaacson claims a ball bearing to reduce friction between the string and the shaft to attain longer sleep times. In order to return the yo-yo to the hand, strands of the string must become caught in the circumferential gap between the periphery of the bearing and the rotating body. U.S. Pat. No. 4,332,102 to Caffrey claiming use of a bearing and a centripitally activated clutch to return the yo-yo to the hand. This invention demonstrates the difficulty of making a yo-yo with very low running friction and having the yo-yo reliably return to the hand at will. U.S. Pat. No. 4,207,701 to Kuhn utilizes a threaded shaft to allow disassembly for easy replacement of the wooden axle which is subject to wear. The two body halves are rotated relative to each other to secure the wood axle within the inward facing counterbores. There is no adjustment feature in this invention. U.S. Pat. No. 4,895,547 to Ameral utilizes a low friction spool on a metal axle having threaded ends. A shoulder at the juncture of the unthreaded portion of the axle interfaces with the face of the threaded insert in each of the yo-yo halves. This interface and associated tolerances allow the yo-yo halves to be tightened on the axle and establishes the space for free rotation of the spool on the axle. This yo-yo has no friction adjustment feature. U.S. Pat. No. 5,017,172 to Serfert utilizes a threaded axle and yo-yo hubs having threaded inserts equivalent to Ameral's invention also incorporating convertible spinning top functions. This invention has no tether gap adjustment features. U.S. Pat. No. 5,100,361 to Kuhn et. al. utilizes a threaded axle as a means of adjusting the gap between the "disk like sides". This invention represents another step in the evolution of low friction sleeping yo-yos. It is dependent on the lateral expansion of an unloaded elastic tether to engage the "disk like sides" to initiate the wind up of the tether from the sleep condition. The adjustment feature requires dismantling of the body halves. A tool or finger nail is required to counter torque the threads to seize the body halves on the axle. Kuhn is staying with the tradition of having the yo-yo body halves fixed to the axle. This is the closest approach to the present invention. The differences between Kuhn's invention and the present invention are as follows:

Kuhn et. al. utilize a smooth disk with a radial dimension equivalent to one tether strand diameter. The tether is looped around the outer bearing race twice such that the greatest width of the tether is at and below the center of rotation where the elastic expansion occurs and makes contact with the disk like surfaces. It is interpreted that the change in friction for initiation of tether windup is caused by the longitudinal elasticity of the tether strands whereby the strands expand diametrically as the strands contract longitudinally during the slackened tether condition. This interpretation requires truly an elastic tether as claimed, not simply a flexible tether.

The present invention utilizes a yoke with an aperture for connecting a single cord tether. The cord is straight with a circular cross section during the sleep condition. The lapper disks have a radial dimension of multi-tether diameters. The lapper disks are in skimming contact with the tether extending above the yoke during the sleep condition. The slackened tether is lapped up in multi-loops between the disks. The frictional drag during the windup of the slackened tether is amplified by the increase of linear tether contact and the transition from tether circular to oval cross-section induced by loop curvature. There is no need to dismantle the present invention to adjust the gap between the two inertial disks. The inertial disks of the present invention are independently rotatably and slidably mounted on the axle. The maximum gap is limited by a threaded knob on the end of the axle having residual torque to fix the adjustment. There is no need for an elastic tether in the present invention.

In all the prior art discovered the yo-yo halves are fixed to the axle or seized to the axle during operation and spin as a unit. All known prior art sleeping yo-yos use a tether consisting of strands looped over the axle or over a bearing or spool resulting in twisted strands and thereby causing a residual torque inducing dreaded precession. All known prior art sleeping yo-yos are designed to have the tether free of any pressureful contact with the inside surfaces of the yo-yo halves during the sleep condition. The present invention utilizes a slight skimming contact between the tether and the lapper disks. The initialization of tether windup is caused by this slight skimming friction, friction between the axle and yoke and circular air motion in the gap between the two inertial disks whereby an arch is formed in the slackened tether whereby the tether cross section becomes oval whereby frictional drag is increased.

The following improvements to yo-yo construction have been patented: U.S. Pat. No. 2,975,547 to Greve claims the two inertial masses mounted on a split pin, allowing the yo-yo to be assembled in different configurations. U.S. Pat. No. 3,081,578 to Mosher uses a hollow sleeve rotatably journaled on a shaft. The shaft is terminated on each end with an abutment. The abutment is used as part of a means of attachment to a finger to allow the user to grip the shaft with one hand while the string is pulled with the other hand to spin the disks. The two inertial disks of this invention are fixed on the sleeve. The floating shaft of this invention is not functionally nor constructurally similar to the present invention. Mosher's invention also has bands of resilient material disposed around the outer maximum periphery of each of the disks for providing a cushioning effect to the disk. The purpose of the resilient material as stated is to cushion the disks—that is to protect the disk. The slight thickness and width of the resilient material is not an effective cushion for the hand. The design of the present invention allows sufficient thickness and width of resilient material to give the feel of catching a rubber ball as the yo-yo returns up the tether to the hand. U.S. Pat. No. 3,805,443 to Duncan Jr. claims the use of a rivet to rigidly clamp the inertial masses to a spool. There are no constructional nor functional equivalences between these inventions and the present invention. U.S. Pat. No. 2,676,432 to Field claims an annular collar with a gap for fixing the string with a knot or flattened end. This is not a sleeping yo-yo. The collar is part of the rotating inertial masses and therefore is not equivalent to the yoke of the present invention.

Foreign patents to Weisshappel, 22,401 in England and 15,824 in Austria claims a "cord fastened by one end" in the base of a deep groove. This is not a sleeping yo-yo and thus has no functional relationship to the present invention. 504,033 to Beresford in England claims an "eye member" to form a loop for use in rope games. This "eye member" is similar to the hitch member claimed as part of the present invention. Beresford does not describe how the cord end is secured in the blind hole of the "eye member". The hitch member of the present invention has a conical shaped through aperture for capturing the bulbous end of the tether cord. There is no known prior art of yo-yo tethers having a hitch as described in the present invention.

The present invention also discloses the use of a Velcro latching strap to attach the end of the tether opposite axle end to the operators finger. This use was not found in prior art.

The present invention also utilizes the existing state of the art yo-yo tether—a string looped once over the axle and twisted to form a coiled single strand. This tether was patented by Murray of the Philippine Islands in 1924. This tether is employed as part of every sleeping yo-yo found in prior art patents. Adjustable performance and non-adjustable yo-yos utilizing lapper disk with this tether are disclosed.

SUMMARY OF THE INVENTION

The present invention comprises functional changes to the yo-yo which provide improved performance and control. The functional changes consists of a floating axle having a threaded knob on the end, independent rotating inertial disks having smooth lapper disks near the center of rotation, a yoke which reduces friction and provides a means of connecting a single cord tether to the axle. The two body halves are made of a resilient material each bonded to one of the inertial disks. The resilient bodies gives the feel of catching a rubber ball as the yo-yo returns up the cord to the hand.

The lapper disks are smooth surfaces extending inward from the inertial disks to make a skimming contact with the cord. The purpose of the independent rotating inertial disks is to allow the adjustment of the lateral proximity of the two lapper disks to the cord. This in effect adjusts the frictional drag of the yo-yo in the sleep condition. The frictional drag in the present invention can thus be optimized to maximize sleep time and still be able to reliably return the yo-yo to the hand at will. The adjustment of frictional drag is made by rotating the threaded knob on the end of the axle. A clockwise rotation will move the two lapper disks closer to the cord.

The primary frictional drag that affects the initial windup of the cord is lateral to the downward thrust of the yo-yo and is thus not significantly effected by the deceleration load when the yo-yo reaches the end of the cord. The yo-yo of the present invention therefore may be thrust downward with great speed and easily achieve the sleep condition. A faster down thrust will result in a higher spin rate and a longer sleep time.

The advantage of using a single cord tether attached by the yoke to the axle is that it does not need to be twisted as in all existing configurations of sleeping yo-yo's. The string torque and resulting precession is eliminated.

A hitch and or a Velcro strap is used at the other end of the tether for easy attachment to and detachment from the middle finger the throwing hand.

Variations of the present invention using the standard twisted pair strand tether are disclosed.

BRIEF DESCRIPTION OF THE DRAWING

FIG. 13 is an isometric cross section view of the adjustable performance yo-yo equivalent to FIG. 1 except it uses the standard twisted pair strand tether with out the yoke. A standard lock nut is also shown as an option to the adjustment knob.

FIG. 14 is an isometric section view of the symmetric half of the adjustable performance yo-yo showing the attachment of an elastic resilient body to the inertial disk.

FIG. 15 shows a Velcro strap on the hand end of the tether.

FIG. 16 is an isometric schematic of the test fixture use to measure the friction characteristics of the woven cord tether.

FIG. 17 is an isometric schematic of the test fixture used to measure the friction characteristics of the standard twisted pair strand tether between two lapper disks.

DETAILED DESCRIPTION OF THE PREFERRED EMBODIMENT

Figure 1:
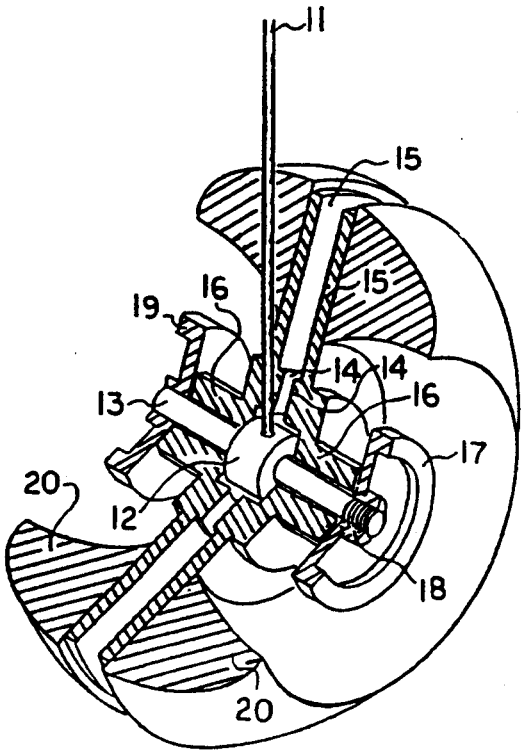
FIG. 1 is an isometric section view of the adjustable performance yo-yo with a yoke interfacing between the axle and a single woven cord tether.

Referring now to FIG. 1, an isometric section view of the present invention is shown. A single cord 11 is attached to the yoke 12 which links the cord 11 to the floating axle 13 and acts as a bearing. The smooth lapper disks 14 extend inward from the two inertial disks 15 and make lateral contact with the cord 11. The inertial disks 15 are made of a high density material such as steel or brass. This results in the center of gravity of each of the two rotating assemblies, each consisting of 14, 15, 16 and 20, to be closer to the cord 11. This minimizes unbalanced torques during the down thrust. The hubs 16, bonded, welded, stamped or cast as part of the inertial disks 15, exist to maintain the two lapper disks 14 parallel to each other, and also act as bearings to allow the two inertial assemblies, each consisting of 14, 15, 16 and 20, the freedom to slip longitudinally on the axle 13. The knob 17 has a threaded interface 18 with the axle 13. This threaded interface 18 also has a self locking feature as used on standard fasteners. The purpose of the thread self locking feature is to prevent the knob 17 adjustment from shifting during operation. The self locking feature may be placed on the axle 13 threads instead. The other knob 19 is fixed to the axle 13. The knobs 17 and 19 are gripped with the fingers, one in each hand, and rotated clockwise to bring the lapper disks 14 into closer proximity to the cord 11 to increase frictional drag. Conversely the knobs 17 and 19 are rotated counter clockwise to reduce friction. The frictional drag in the present invention can thus be optimized to maximize sleep time and still be able to reliably return the yo-yo to the hand at will. This adjustment feature is an advantage because manufacturing tolerances, variations in cord diameter and cord wear effect the skimming action of the lapper disks 14 on the cord 11.

Another advantage of the present invention is that the primary frictional drag that affects the initial wind up of the cord 11 is lateral to the downward thrust of the yo-yo and is thus not significantly effected by the linear deceleration load when the yo-yo reaches the end of the cord 11. The yo-yo of the present invention may thus be thrust downward with great speed and easily achieve the sleep condition.

The two body 20 halves bonded to the inertial disks 15 are made of resilient material such as polyurethane to cushion the hand from impact. A yo-yo thrown down at great speed will also return to the hand with great speed if sleep condition is not achieved. It is an advantage to place the high density material in the plane close to the cord 11 to minimize unbalanced torques during the down thrust. In U.S. Pat. No. 4,437,261, MacCarthy states: "It is possible to fabricate the body of the yo-yo from a variety of materials, such as wood; plastic, metal; rubber composite, etc." MacCarthy states no intent to have an inertial disk 15 of high density material such as steel or brass and a separate low density resilient material to cushion the hand as conceived in the present invention.

Figure 2:
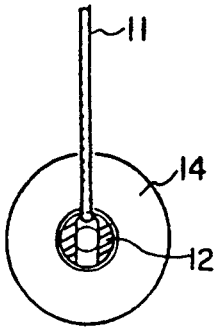
FIG. 2 is a side view of the lapper disks relative to the cord during the sleep condition.
Figure 3:
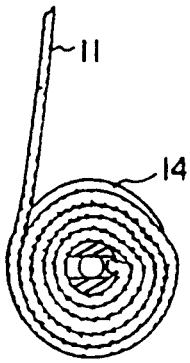
FIG. 3 is a side view of the lapper disks following initial wind up.

Referring to FIGS. 2 and 3, the friction between the cord 11 and the lapper disks 14 is explained. Assume a lapper disk 14 outside and inside diameter of 0.75 and 0.25 inches respectively and a cord diameter of 0.0815. In FIG. 2 with the yo-yo in the sleep condition, the lapper disks 14 make contact with only 0.25 inches of cord 11 length. The contact need only be a slight skim. The yo-yo is returned to the hand from the sleep condition by a slight jerk of the cord 11, which produces a momentary slack in the cord 11. The slack cord 11 is rapidly lapped up between the two lapper disks 14 as shown in FIG. 3, where 4.81 inches of cord 11 length is in direct contact with the two lapper disks 14. The frictional drag is directly proportional to the length of the cord 11 in pressureful contact between the two lapper disks 14. The cord 11 length in direct contact with the lapper disks 14 is increased by a factor of 19.24. The cord 11 contact length wound within the lapper disks 14 is approximated by the following formula.

Cord contact length L=disk area/cord diameter $$L=(\pi/4)(D_0^2-D_1^2)/d$$

$$L=(\pi/4)(0.75^2-0.25^2)/0.0625$$

L=4.81 inches

Where $D_0$ and $D_1$ are the outer and inner diameters of the lapper disks 14 and d is the diameter of the cord 11. The general equation for the factor of increase in cord contact for the lapper disks 14 is:

$$F=\pi(D_0+D_1)/2d$$

The drag friction is further amplified by the change in cord 11 cross section which makes a transition from circular to oval as the cord 11 is wound within the lapper disks 14. This oval condition increases the pressureful contact between the cord 11 and the lapper disk 14.

Figure 4:
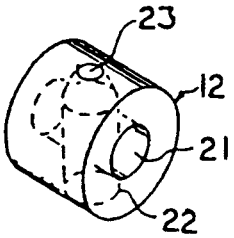
FIG. 4 is an enlarged isometric hidden line view of the yoke.
Figure 5:
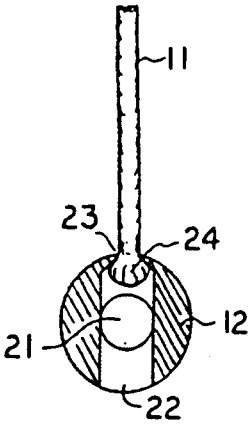
FIG. 5 is an enlarged cross section view of the yoke showing the cord interface.

Referring to FIG. 4 the yoke 12 configuration is shown. The yoke 12 is of a cylindrical shape with a hole 21 passing through the center on the longitudinal axis for the axle 13 to pass through. The surfaces of the hole 21 may be coated with a solid lubricant such as molybdenum disulfide or teflon to reduce friction. The present invention may be easily disassembled in order to lubricate the yoke 12 and axle with any common lubricant as desired by the user. The cord 11 receptacle 22 is a hole passing through the center of the yoke 12 perpendicular to the axle hole 21. The receptical hole has a funnel shaped exit 23 for trapping the bulbous end of the cord 11 as described in the following: The cord 11 is inserted into the receptical 22 then with a twisting motion pushed through the funnel shaped exit 23. The cord 11 is then pulled through the yoke 12 leaving about two inches remaining. The flame of a match is used to melt the end of the polyester cord 11. A small hard bulb 24 will be formed on the end of the cord 11 as it cools in a manner of seconds. The remaining cord 11 is then pulled through until the bulb 24 is caught in the funnel 23 as shown in FIG. 5. The axle 13 is then inserted in to the hole 21 to verify that the bulb 24 will not interfere with the rotation of the axle 13.

The yo-yo of the present invention is assembled as shown in FIG. 1. The knobs 17 and 19 are rotated clockwise relative to each other until the lapper disks 14 appear to be making a skimming contact with the cord 11.

Another feature of the present invention is the ease of winding up the cord 11 by hand as described in the following: One of the knobs 17 or 19 is gripped with the fingers and pulled reacting the force with the knuckles against the body 20. This results in the cord 11 being pinched between the two lapper disks 14 so that the cord 11 may be easily wound up in the gap between the two lapper disks 14 and the two inertial disks 15 with the other hand. The yo-yo is now thrust downward. If the yo-yo returns immediately to the hand without sleeping, the knobs 17 and 19 are adjusted counter clockwise relative to each other to move the lapper disks 14 apart. If the yo-yo sleeps but will not return to the hand with a slight jerk of the cord 11, the knobs 17 and 19 are adjusted clockwise to move the lapper disks 14 closer to the cord 11. The user may desire to have the adjustment on the tight side to purposely have the yo-yo instantly return to the hand just as in the days of old.

Another advantage of the present invention is that a single cord 11 is used. All sleeping yo-yo's discovered in the novelty search use the standard twisted pair strand tether. This is true in U.S. Pat. No. 3,175,326 by Isaacson and U.S. Pat. No. 4,332,102 by Caffrey where bearings are used. In conventional yo-yo's such as U.S. Pat. No. 2,629,202 by Stivers et. al. and U.S. Pat. No. 3,256,635 by Radovan, strand twist is required to form a semitight loop around the axle to create enough frictional drag to initiate tether windup when the tether is slackened. If the loop is too loose there is zero friction in the slack tether condition. Tether strand twist is required to provide some degree of friction. The disadvantage of the yo-yo requiring a twisted strand tether is that a torque is produced about the tether axis, which in turn causes precession as pointed out by MacCarthy in U.S. Pat. No. 4,437,261. Precession causes the tether to rub on the periphery of the yo-yo and thus shortens the sleep time. In the present invention there is no need to twist the cord 11 and thus the tendency to precess is reduced. All other patents with single unlooped tethers discovered in the novelty search do not have the ability to sleep.

Figure 6:
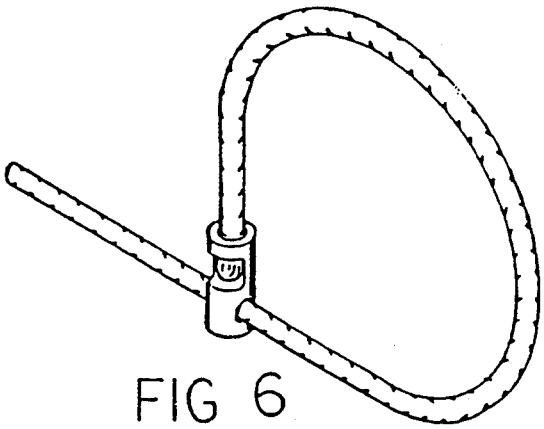
FIG. 6 shows the hitch being used to form a running noose on the hand end of the cord tether.

Another innovation of the present invention is shown in FIG. 6. A variation of the yoke 12 is the hitch member 25 used to form a running noose on the hand end of the cord 11. The cord 11 will not be twisted in the process of winding up by hand if the cord 11 is detached from the hand. Thus easy attachment to, and detachment from the hand allowed by the hitch member 25 is a useful addition.

Figure 7:
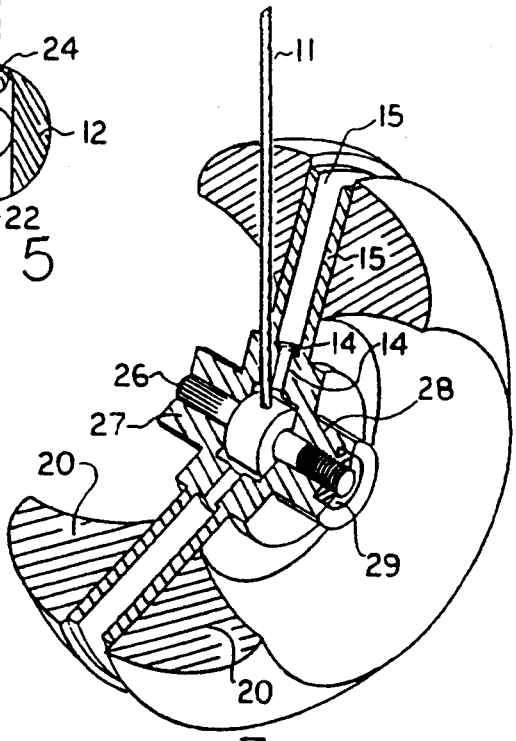
FIG. 7 is an isometric section view of the adjustable performance yo-yo with an axle and hub modification.

A variation of the adjustable performance yo-yo is shown in FIG. 7. One end of the axle 26 is fixed to the hub 27. The other end of the axle 26 is threaded directly into the other hub 28. The adjustment of the lapper disks 14 proximity to the cord 11 is made by rotating the two inertial disks 15 relative to each other by gripping each body 20. A thread locking feature is provided by a nylon plug 29 bonded into the hub 28. The cord 11 is wound by hand by first rotating the two inertial disks 15 clockwise relative to each other to squeeze the cord 11 between the two lapper disks 14. Next all the cord 11 is wound in the gap between the two inertial disks 15. The two inertial disks 15 are then rotated back counter clockwise to the original desired adjustment.

The adjustable performance yo-yo's shown in FIGS. 1 and 7 may be wound by hand as prior art sleeping yo-yo's are. The cord 11 or the twisted strand tether is pressed against one of the body 20 halves with an index finger of one hand, while the remainder is wound up in the gap over the section pressed in place with the other hand.

The standard twisted pair strand tether used in present day yo-yos also works well with the lapper disks of the present invention. Experiments were performed using the Duncan yo-yo tether. This twisted pair strand does not oval as the woven polyester cord described above. The individual tether strands being made of cotton and having a diameter of only 0.0325 inches does not oval with bend radius of the tether during initial wind up. However, the bend radius does cause the twisted coils of each of the two strands to kink and separate from each other, thereby increasing the width of the tether from 0.065 inches to typically 0.080 inches. This separation of strands within the gap of the lapper disks is further forced as another layer of tether is looped over on top of it.

Figure 8:
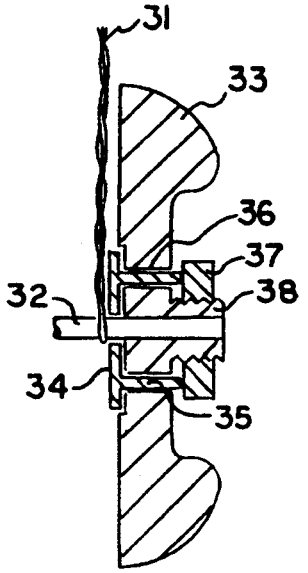
FIG. 8 is a frontal cross section view of the symmetric half of the adjustable performance yo-yo showing a variation of lapper disk and knob construction.
Figure 9:
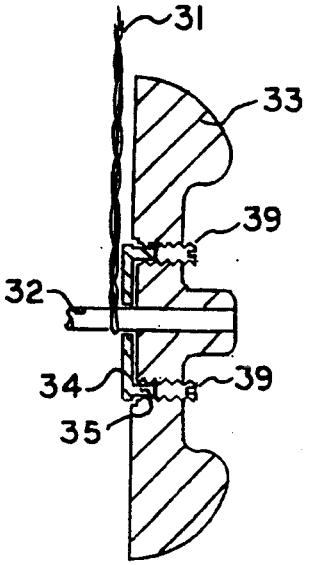
FIG. 9 is a frontal cross section view of the symmetric half of the adjustable performance yo-yo showing use of set screws to adjust the lapper disk position.
Figure 10:
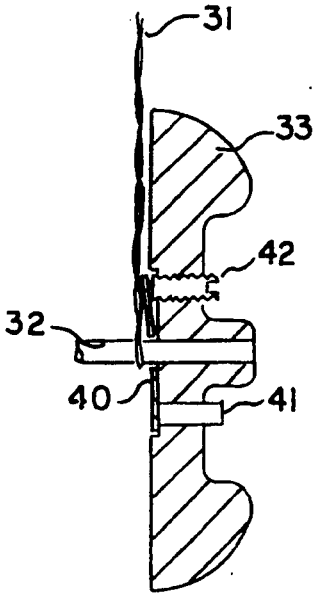
FIG. 10 is a frontal cross section view of the symmetric half of the adjustable performance yo-yo showing use of a set screw to adjust a flexible lapper disk.

Variations in adjustable lapper disks on fixed shaft yo-yos are shown in FIGS. 8, 9 and 10. The views are a frontal cross section of the symmetrical halves. In each of these figures the conventional tether 31 is looped about the shaft 32. The shaft 32 is rigidly fixed to the body 33.

Referring to FIG. 8, the lapper disk 34 is rotationally constrained by the pins 35 extending from the back side of the lapper disk 34. The pins 35 protrude through the holes 36 in the body 33. The threaded knob 37 is rotated on the threaded hub 38 against the pins 35 to adjust the proximity of the lapper disk 34 to the tether 31.

Referring to FIG. 9, set screws 39 are rotated against the pins 36 to adjust the proximity of the lapper disk 34 to the tether 31.

Referring to FIG. 10, a flexible lapper disk 40 is fixed on one edge by the anchor stud 41. The set screw 42 is rotated to deflect the opposite edge of the lapper disk into skimming contact with the tether 31.

Figure 11:
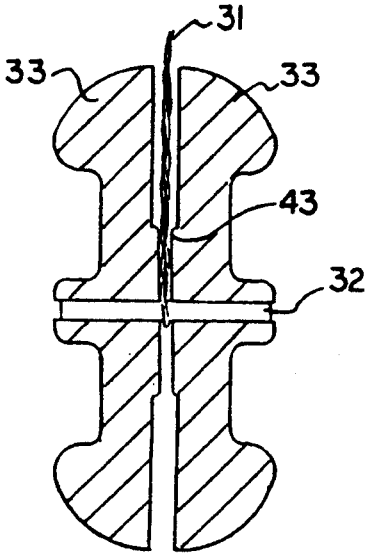
FIG. 11 is a frontal cross section view of a variation of the present invention with a fixed shaft and fixed gap between the two lapper disk surfaces.

Referring to FIG. 11, the simplest lapper disk design of the present invention is shown. No lapper disk adjustment is made by the user. The gap between the lapper disk surfaces 43 is set at the factory. In prior art sleeping yo-yos using a looped string tether, a certain level of frictional drag between the string loop and the shaft is required to initiate the wind up of the tether from the sleep condition. The magnitude of the frictional drag is affected by the tightness of the loop about the shaft. The tightness of the loop is affected by the degree of twist in the tether. In prior art yo-yos, the shaft diameter has a lower limit because of the need to have sufficient frictional drag between the tether loop and the shaft. The shaft diameter of prior art yo-yos are typically 0.25 inches. Imagine a yo-yo with a shaft the size of a sewing needle. The frictional drag would obviously be very low. The tether would require a high degree of twist to tighten the loop on the shaft to achieve sufficient frictional drag to initiate tether wind up from the sleep condition. As presented above, tether twist induces precession during the sleep condition. There is a trade off between shaft diameter and tether twist in prior art yo-yos.

Referring again to FIG. 11, the frictional drag in this version of the present invention is also adjusted by the degree of tether 31 twist as in prior art looped string tether yo-yos; however, here the diameter of the tether 31 affects the frictional drag or the skimming action of the lapping surfaces 43. Instead of adjusting the position of the lapper disks to skim the cord 11 or tether 31 as described FIGS. 1, 7, 8, 9, and 10, the diameter of the tether 31 is adjusted by the degree of twist.

Figure 12:
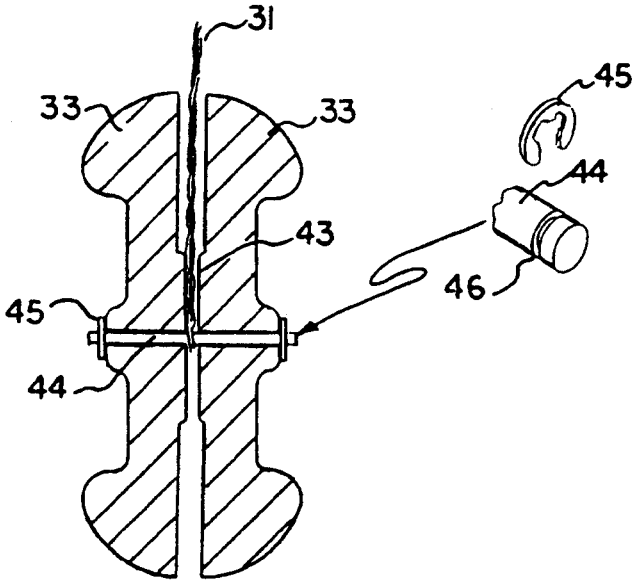
FIG. 12 is a frontal cross section view of a variation of the present invention with a floating axle having retainer rings on each end fixing the maximum gap between the two lapper disk surfaces.

Referring to FIG. 12, a small diameter floating axle 44 is used. Standard retainer rings 45 are used to retain the body halves 33 on the floating axle 44. The retainer rings 45 fit in square groves 46 on the ends of the axle 44. The retainer rings 45 also allow easy disassembly to polish the surface of the lapper disks for smooth operation. The body halves 33 are independently and rotatably mounted on the axle 44.

The adjustable performance yo-yo shown in FIG. 1 using the standard twisted pair strand tether 31 without the yoke 12 is shown in FIG. 13. The adjustment functions are the same as described for FIG. 1. A standard lock nut 17A is also shown as an option to the adjustment knob 17. The axle 13 has threads and a nut 17A on each end. Two wrenches are required to make the adjustment of the gap between the two lapper disks 14. The standard twisted pair strand tether 31 may also be used in FIG. 7 replacing the cord 11 and without the yoke 12.

Referring to FIG. 14, another variation of attaching a resilient body 49 to the inertial disk 46 is shown. The body 49 is a casting of a material such as silicon rubber. The inertial disk is stamped from a high density plate material such as steel or brass forming the lapper disk 47 and the rim 48 around the circumference. The rim 48 interlocks with the bead 50 of the elastic body 49. The elastic body 49 is stretched into position and is held in place by elastic forces. No bonding is required. The hub 51 is welded to the inertial disk 46.

Another innovation of this invention is the Velcro strap 54 fastened to tether 31 shown in FIG. 15. The Velcro strap 54 makes it easy to attach and detach the tether from the hand.

The following is a description of tests conducted to measure the friction characteristics of the polyester woven cord and the standard cotton twisted pair strand tether within the lapper disks.

A sample of polyester woven cord 11 from Graber Industries of Wisconsin was measured and tested. The circular cross section diameter was measured to be 0.0815 inches. The cord 11 oval major diameter was measured for incremental loop diameters. Measurements were made and averaged. The results are shown in Table 1. This oval condition results in an interference fit between the lapper disks and the cord. The interference fit is defined as the difference between the circular cross section diameter and the major diameter of the oval cross section. The interference fits corresponding to the loop diameter are shown in column 3 of Table 1. The frictional drag of the cord pulled between two polished brass plates was measured in the test fixture shown in FIG. 16. The brass plate 60 is fixed. The position of the brass plate 61 is adjusted by the screw 64 threaded in to the fixed plate 62. The fixed plate 63 reacts the frictional force on plate 61. Knowing the threads per inch of the screw 64, the degree scale 65 was used to adjust the gap to create the interference fits of the tether 11 shown in the third column of Table 1. The thread 67 tied to the tether 11 end is passes over the pulley 66 and is tied to the light weight plastic pouch 67. Pennies were added to the pouch 68 until the cord 11 slipped. The pennies provided a measure of frictional drag. The frictional drag in pounds per inch of cord 11 length for each interference fit are shown in the fourth column of Table 1.

TABLE 1

| Loop Diameter (Inches) | Major Diameter (Inches) | Interference Fit (Inches) | Frictional Drag (Pounds/Inch) |
|---|---|---|---|
| .3 | .0945 | .0110 | .070 |
| .4 | .0918 | .0085 | .052 |
| .5 | .0895 | .0055 | .034 |
| .6 | .0868 | .0035 | .019 |
| .7 | .0847 | .0015 | .011 |
| .8 | .0830 | .0005 | .006 |
| Straight | .0815 | .0 | .0 |

The cord 11 loop numbers and corresponding loop diameters are shown in Table 2. The length of cord 11 in each loop is shown in the third column of Table 2. The frictional drag per inch is interpolated for each loop diameter from Table 1 and is shown in the fourth column of Table 2. The cord 11 net frictional drag for each loop is obtained by multiplying the third and fourth columns together, which is shown in the fifth column. The frictional drag torque for each loop is obtained by multiplying the net drag and loop diameter and dividing by 2.0. The total frictional drag torque is the sum of column six.

TABLE 2

| Loop Number | Mean Diameter (Inches) | Cord Length (Inches) | Drag (Lbs/In) | Net Drag (Lbs) | Drag Torque (In-Lbs) |
|---|---|---|---|---|---|
| 1 | .33 | 1.04 | .069 | .072 | .012 |
| 2 | .49 | 1.54 | .036 | .055 | .014 |
| 3 | .65 | 2.04 | .015 | .031 | .010 |
| Total length = | | 4.62 | Total Drag Torque = | | .036 |

The lapper disks 14 are very effective in initiating the return of the yo-yo to the hand from the sleep condition. For example assume that the yo-yo has coasted down to 10 revolutions per second in the sleep condition. The cord 11 is jerked and the slack cord 11 is lapped up by the lapper disks 14. A substantial amount of slippage is occurring at this condition. The equation for mechanical power of the frictional drag torque is:

$$P=T_f W$$

where P is power, $T_f$ is the total frictional drag torque from Table 2 and w is the rotational speed in radians per second. At 10 revolutions per second or 62.8 radians per second, the power is:

$$0.036\times 62.8=2.26 \text{ In-Lbs/Sec}$$

A typical yo-yo weighs about 0.1 pounds. The frictional drag power of the lapper disks 14 will initiate the return of the yo-yo back to the hand at 22.6 inches per second for the above speed condition. The remainder of the cord 11 becomes tightly wedged in the larger gap between the two inertial disks 15 radially beyond the outer diameter of the lapper disks 11. The binding of the cord 11 in the gap imparts equal angular acceleration to both independently rotatable inertial disks 15 as the adjustable performance yo-yo is thrust downward.

Tether friction within the lapper disks was measured using a Duncan yo-yo tether 31 in the test fixture shown in FIG. 17. Two rivets with ½ inch diameter flat heads 70 were used as lapper disks with a gap of 0.065 inches; fixed by the set screws 72 on the 1/16 inch diameter axle 71. The contact length of the tether 31 with the lapper disks 70 is only 0.22 inches with the lapper disk jig subtended by the tether 31. The lapper disk 70 surfaces are in contact with only the cotton fuzz on the surface of the tether 31. This represents the sleep condition with very low friction. The small diameter axle 71 also contributes very low friction. The tether 31 was looped within the fixed lapper disks 70. The set screw 73 prevents the jig from rotating. The pouch 75 is attached to the tether 31 by the thread 74. Pennies used as measures of weight were added to the pouch 75 until the tether 31 looped within the lapper disks 70 slipped. This was repeated at ½ inch increments of tether pulled from the lapper disks 70. The frictional drag data for the variation of tether length wound within the lapper disks 70 is shown in Table 3.

TABLE 3

| L Tether Length (inches) | $r_m$ Mean Radius (inches) | $F_d$ Friction Force (Lbs) | $T_d$ Friction Torque (in-lbs) |
|---|---|---|---|
| 3.5 | .222 | .0798 | .0180 |
| 3.0 | .204 | .0684 | .0140 |
| 2.5 | .184 | .0570 | .0105 |
| 2.0 | .162 | .0430 | .0070 |
| 1.5 | .138 | .0342 | .0047 |
| 1.0 | .108 | .0228 | .0025 |
| 0.5 | .071 | .0114 | .0008 |
| 0.0 | .000 | .0000 | .0000 |

A point of interest is that 3.5 inches of tether could be looped within the lapper disks 70 with the above given dimensions. Mathematically only 2.95 inches of tether can be wound assuming a circular cross section diameter of 0.065 inches. The spiral shape of the twisted pair strands allow intermesh at the interface between loops. The effective radial thickness of each loop is given by:

$$t=\pi/4(D_0^2-D_1^2)/L$$

or $$\pi/4(0.5^2-0.625^2)/3.5=0.055 \text{ inches}$$

The outside diameter of the tether looped within the lapper disks as a function of the tether length L wound is obtained by solving the above equation for $D_0$.

$$D_0=\sqrt{4/\pi(tL)+D_1^2}$$

The mean radius of the tether from the center of the axle is given by:

$$r_m = 0.5\sqrt{4/\pi(tL)+D_1^2-0.5t}$$

The friction drag torque is given by:

$$T_d = F_d r_m$$

As calculated for the same speed condition as above for the polyester cord but with 0.018 in-lbs of drag torque, the mechanical power of the frictional drag is:

$$P_f = T_r w$$

or:

$$(0.018)(62.8) = 1.13 \text{ in-lbs/sec}$$

For a yo-yo weighing 0.1 pounds, the initial rise rate will is 11.3 in/sec. After the tether is wound a few loops beyond the lapper disks where the tether becomes wedged and slippage stops, the rise rate will about 15 in/sec.

What I claim is:

1. A yo-yo comprising in combination:

a. axle means, b. string looped about central portion of said axle means defining a twisted spiraled strand means, c. two inertial disks each rigidly fixed on each end of said axle means and spaced to define a first gap between said two inertial disks, d. flat smooth annular surface means on facing surfaces of each of said inertial disks whereby skimming contact with said twisted spiraled strand means extending above said axle in said first gap is effected and whereby the said skimming contact length of said twisted spiraled strand means is defined by $$(\pi/4)(D_0^2-D_1^2)/d$$

at the completion of slack said twisted spiraled strand means loops wound within the said flat smooth annular surface means, where $D_1$ and $D_0$ are the inside and outside diameter of said flat smooth annular surface means and d is the diameter of said twisted spiraled strand means and where looping and overlapping of said twisted spiraled strand means causes said twisted spiraled strands means to oval and intermesh thereby increasing pressure of said skimming contact between said flat smooth annular surface means and said twisted spiraled strand means, e. second surface means on said inertial disks extending radially beyond said flat smooth annular surface means, whereby said gap between the said two inertial disks at said second surface means forms a second gap which is larger than said first gap to inhibit said further skimming contact with said twisted spiraled strand means and wherein said twisted spiraled strand means may be wound in second gap beyond said flat smooth annular surface means.

2. A yo-yo as claimed in claim 1 wherein said axle means is of diameter less or equal to 0.125 inches.

3. A yo-yo comprising in combination:

a. axle means having circumferential grooved ends, b. string looped about central portion of said axle means defining a twisted spiraled strand means, c. two inertial disks each having a hub with cylindrical bearing means, said disks mounted on and allowing independent rotating motion on each end of said axle means and spaced to define a first gap between said two inertial disks, d. flat smooth annular surface means on facing surfaces of each of said inertial disks whereby skimming contact with said twisted spiraled strand means extending above said axle in said first gap is effected and whereby the said skimming contact length of said twisted spiraled strands means is defined by $$(\pi/4)(D_0^2-D_1^2)/d$$

at the completion of slack said twisted spiraled strand means loops wound within the said flat smooth annular surface means, where $D_1$ and $D_0$ are the inside and outside diameter of said flat smooth annular surface means and d is the diameter of said twisted spiraled strand means and where looping and overlapping of said twisted spiraled strand means causes said twisted spiraled strands means to oval and intermesh thereby increasing pressure of said skimming contact between said flat smooth annular surface means and said twisted spiraled strand means, e. second surface means on said inertial disks extending radially beyond said flat smooth annular surface means, whereby said gap between the said two inertial disks at said second surface means forms a second gap which is larger than said first gap to inhibit further said skimming contact with said twisted spiraled strand means and wherein said twisted spiraled strand means may be wound in second gap beyond said flat smooth annular surface means, f. retainer ring means set in said circumferential groves on each end of said axle means whereby the said inertial disks are retained on said axle means and whereby manufacturing tolerances establish said first gap between said two inertial disks.

4. A yo-yo as claimed in claim 3 wherein said axle means is of diameter less or equal to 0.125 inches.

5. An adjustable performance yo-yo comprising in combination:

a. axle means, b. string looped about central portion of said axle means defining a twisted spiraled strand means, c. two inertial disks each rigidly fixed to each end of said axle means, d. flat smooth annular surface means on facing surfaces of each of said inertial disks are rotationally constrained to each of said two inertial disk, and each of the said two flat smooth annular surface means are independently extendable from each of said inertial disks to define a first gap whereby skimming contact with said twisted spiraled strands means extending above said axle in said first gap is effected and whereby the said skimming contact length of said twisted spiraled strand means is defined by $$(\pi/4)(D_0^2-D_1^2)/d$$

at the completion of slack said twisted spiraled strand means loops wound within the said flat smooth annular surface means, where $D_1$ and $D_0$ are the inside and outside diameter of said flat smooth annular surface means and d is the diameter of said twisted spiraled strand means and where looping and overlapping of said twisted spiraled strand means causes said twisted spiraled strands means to oval and intermesh thereby increasing pressure of said skimming contact between said flat smooth annular surface means and said twisted spiraled strand means, e. second surface means on said inertial disks extending radially beyond said flat smooth annular surface means, whereby said gap between the said two inertial disks at said second surface means forms a second gap which is larger than said first gap to inhibit further said skimming contact with said twisted spiraled strand means and wherein said spiraled strands means may be wound in second gap beyond said flat smooth annular surface means, f. set screw means within said inertial disks provide means to adjust said extension of said flat smooth annular surface means.

6. An adjustable performance yo-yo comprising in combination:

a. axle means having one threaded end and one non-threaded end, b. string looped about central portion of said axle means defining a twisted spiraled strand means, c. two inertial disks wherein one of said inertial disks is fixed to said axle means on a non-threaded end by press fit, the other with internal threads interfacing with said axle threaded end wherein said inertial disks are rotated relative to each other to adjust space between said two inertial disks to define a first gap, d. flat smooth annular surface means on facing surfaces of each of said inertial disks whereby skimming contact with said twisted spiraled strand means extending above said axle in said first gap is effected and whereby the said skimming contact length of said twisted spiraled strands means is defined by $$(\pi/4)(D_0^2-D_1^2)/d$$

at the completion of slack said twisted spiraled strand means loops wound within the said flat smooth annular surface means, where $D_1$ and $D_0$ are the inside and outside diameter of said flat smooth annular surface means and d is the diameter of said twisted spiraled strand means and where looping and overlapping of said twisted spiraled strand means causes said twisted spiraled strands means to oval and intermesh thereby increasing pressure of said skimming contact between said flat smooth annular surface means and said twisted spiraled strand means, e. second surface means on said inertial disks extending radially beyond said flat smooth annular surface means, whereby said gap between the said two inertial disks at said second surface means forms a second gap which is larger than said first gap to inhibit further said skimming contact with said twisted spiraled strand means and wherein said twisted spiraled strand means may be wound in second gap beyond said flat smooth annular surface means.

7. An adjustable performance yo-yo comprising in combination:

a. axle means having one threaded end and one non-threaded end, b. string looped about central portion of said axle means defining a twisted spiraled strand means, c. two inertial disks, each disk having a hub with cylindrical bearing means, said disks mounted on and allowing independent rotating motion on each end of said axle means and spaced to define a first gap between said two inertial disks, d. flat smooth annular surface means on facing surfaces of each of said inertial disks whereby skimming contact with said twisted spiraled strand means extending above said axle in said first gap is effected and whereby the said skimming contact length of said twisted spiraled strands means is defined by $$(\pi/4)(D_0^2-D_1^2)/d$$

at the completion of slack said twisted spiraled strand means loops wound within the said flat smooth annular surface means, where $D_1$ and $D_0$ are the inside and outside diameters of said flat smooth annular surface means and d is the diameter of said twisted spiraled strand means, and where looping and over lapping of said twisted spiraled strand means causes said twisted spiraled strands means to oval and intermesh thereby increasing pressure of said skimming contact between said flat smooth annular surface means and said twisted spiraled strand means, e. second surface means on said inertial disks extending radially beyond said flat smooth annular surface means, whereby said gap between the said two inertial disks at said second surface means forms a second gap which is larger than said first gap to inhibit further said skimming contact with said twisted spiraled strand means and wherein said twisted spiraled strand means may be wound in second gap beyond said flat smooth annular surface means, f. two knob means, one fixed to said axle upon a non-threaded end by press fit, the other with threads interfacing on said axle threaded end whereby relative rotation of said two knob means provides adjustment means of said first gap between said two inertial disks.

8. An adjustable performance yo-yo as claimed in claim 7, wherein two nut means one fixed to said axle upon a non-threaded end by press fit, the other with threads interfacing on said axle threaded end whereby relative rotation of said two nut means provides adjustment means of said first gap between said two inertial disks.

9. An adjustable performance yo-yo as claimed in claim 7, wherein said inertial disks are made of a high density plate material and have a relatively low density resilient body permanently bonded to said inertial disks.

10. An adjustable performance yo-yo as claimed in claim 7, wherein said inertial disks are made of a high density plate material and have a relatively low density body made of one of wood and plastic permanently bonded to said inertial disks.

11. An adjustable performance yo-yo as claimed in claim 7, wherein said inertial disks are made of a high density plate material having a rim means formed on circumference interfacing with an elastic resilient body.

* * * * *